US008147746B2

(12) United States Patent
Nishimura

(10) Patent No.: US 8,147,746 B2
(45) Date of Patent: Apr. 3, 2012

(54) APPARATUS FOR PRECIPITATION/SEPARATION OF EXCESS COPPER IN LEAD-FREE SOLDER

(75) Inventor: Tetsuro Nishimura, Osaka (JP)

(73) Assignee: Nihon Superior Sha Co., Ltd. (JP)

( * ) Notice: Subject to any disclaimer, the term of this patent is extended or adjusted under 35 U.S.C. 154(b) by 242 days.

(21) Appl. No.: 12/518,656

(22) PCT Filed: Dec. 14, 2006

(86) PCT No.: PCT/JP2006/324949
§ 371 (c)(1),
(2), (4) Date: Sep. 2, 2009

(87) PCT Pub. No.: WO2008/072330
PCT Pub. Date: Jun. 19, 2008

(65) Prior Publication Data

US 2010/0007068 A1 Jan. 14, 2010

(51) Int. Cl.
*C22B 15/14* (2006.01)

(52) U.S. Cl. ..... 266/205; 266/227

(58) Field of Classification Search ..... 266/205, 266/227, 228, 232
See application file for complete search history.

(56) References Cited

U.S. PATENT DOCUMENTS 5,388,756 A 2/1995 Howlett
5,948,312 A * 9/1999 Gates ..... 266/228

FOREIGN PATENT DOCUMENTS

JP 59159267 A * 9/1984
JP 01-168826 7/1989
JP 05-295461 11/1993
JP 2006-206951 10/2006

OTHER PUBLICATIONS

International Search Report, International Application No. PCT/JP2006/324949 (mailed Jan. 15, 2007; published Jun. 19, 2008).
Written Opinion, International Application No. PCT/JP2006/324949 (Jan. 23, 2007).

* cited by examiner

*Primary Examiner* — Scott Kastler
(74) *Attorney, Agent, or Firm* — Thompson Hine LLP

(57) ABSTRACT

An apparatus for depositing and separating excess copper dissolved in molten lead-free solder containing tin as the main element is provided. An apparatus 1 deposits excess copper in the molten lead-free solder as an intermetallic compound and separates it from the molten solder. The apparatus includes a deposition bath 2 for causing an intermetallic compound in the molten solder, a metal added from the outside and copper in the molten solder to be deposited, a granulation bath 4 including plates 31 32 and 33 for allowing the molten solder to pass through the plates to merge the intermetallic compounds into particles having a larger diameter, and a separation bath 5 for causing the enlarged intermetallic compounds to precipitate and separate in the molten solder.

5 Claims, 7 Drawing Sheets

RECYCLING OF Sn

APPARATUS FOR PRECIPITATION/SEPARATION OF EXCESS COPPER IN LEAD-FREE SOLDER

TECHNICAL FIELD

The present invention relates to an apparatus for depositing and separating excess copper dissolved in lead-free solder containing tin as a main component thereof in a soldering process of devices on a printed board having copper plating or copper leads.

BACKGROUND ART

Lead-free solder contains, in addition to tin (Sn) as the main element thereof, copper, silver, zinc, nickel, cobalt, bismuth, indium, phosphorus, germanium, etc. in proper concentrations thereof. Lead-free solder exhibits wetting effect at the melting point thereof or a higher temperature, typically, at 250° C. or higher. In the soldering process, a component such as a printed board is immersed into a lead-free solder bath heated at a temperature within that temperature range, or put into contact with molten solder wave generated in a solder bath.

Copper used onto the printed board or component leads is heated to the above-mentioned temperature range in the soldering process, and dissolves into the molten solder. This is so-called "copper leaching." When copper leaching takes place, the copper concentration in the solder bath sharply rises, and it leads to a rise in the melting point of solder. Surface tension and fluidity of solder are also affected. As a result, soldering defects such as surface roughness of soldering finish, solder bridge, pits, dry joints, projections, and icicles, are caused, and soldering quality is degraded.

If the copper concentration rises in the solder bath, part or whole of the solder in the solder bath is entirely replaced. Drained solder is dumped or processed to separate excess copper to recycle tin. Recycled tin is re-used as a solder resource material.

Known tin recycling methods include a method of using difference of the melting points, an electrolytic refining method, etc.

The known tin recycling method requires a large-scale facility, and thus a large facility installation area. To keep a material to be refined at a high temperature, flames must be properly handled, and heaters consuming a high electric power, an electrolysis bath, etc. must be required. The installation of these devices leads to environmental problems, exposing workers to dangerous and inefficient jobs there.

DISCLOSURE OF INVENTION

Problems to Be Solved by the Invention

The present invention has been developed to overcome the known problems, and it is an object of the present invention to provide an apparatus that precipitates and separates excess copper dissolved in lead-free solder to recycle tin safely and efficiently.

Means to Solve the Problems

To achieve the above object, the inventor of this invention has studied the problems and obtained the following knowledge.

(1) If an appropriate amount of a mother alloy that is made by diluting a metal element such as Ni, Co, Fe and the like in high-concentration with pure tin was added to a lead-free solder having excess copper dissolved therein, a tin-copper molten alloy reacted with an added element included in the mother alloy, thereby depositing intermetallic compounds, such as $(CuX)_6Sn_5$ system compound (X is the added element such as Ni, Co, Fe, etc.). If the $(CuX)_6Sn_5$ system compound is separated, the remaining tin (Sn) can be retrieved.

(2) The $(CuX)_6Sn_5$ system compound form fine particles, and floats in the molten solder. Retrieval of the $(CuX)_6Sn_5$ system compound is not so easy. If the molten solder is left for a long period of time, the $(CuX)_6Sn_5$ system compound precipitates and becomes easy to retrieve. However, maintaining the molten solder at a temperature range of from 230 to 250° C. for a long period of time leads an increase in energy costs. When the $(CuX)_6Sn_5$ system compound is separated and removed in an efficient manner, enlarging the otherwise fine particles in size to increase a precipitation speed is effective.

The inventor of this invention has further studied the molten lead-free solder based on the above knowledge, and have found that if the molten solder with the intermetallic compound deposited is passed through a plate having a large number of fine openings, the fine particle compounds mutually merge together becoming enlarged through the passage of the openings. The enlarged intermetallic compounds in the molten solder exhibit a higher precipitation speed than the pre-merged fine intermetallic compounds.

The present invention is a deposition and separation apparatus for depositing and separating, as an intermetallic compound, excess copper dissolved in molten lead-free solder having tin as the main element thereof. The apparatus includes a deposition bath for causing an intermetallic compound of tin in the molten lead-free solder, a metal added from the outside and copper in the molten lead-free solder to be deposited with the lead-free solder maintained at a molten state thereof, a granulation bath including a plate for allowing the molten lead-free solder to pass through the plate to merge the intermetallic compounds with each other into particles having a larger diameter, and a separation bath for causing the enlarged intermetallic compounds to precipitate and separate in the molten lead-free solder.

Preferably, the granulation bath includes a first plate having a large number of openings, each opening having a smaller diameter, and a second plate having a large number of openings, each opening having a larger diameter, and the granulation bath causes the molten lead-free solder to pass through the second plate after causing the molten lead-free solder to pass through the first plate. With this arrangement, the intermetallic compounds having merged while passing through the smaller openings further merge while passing through the larger openings. Since the intermetallic compounds gradually merge with increasingly larger diameter, a precipitation and separation process is more efficiently performed in the separation bath.

The granulation bath preferably includes a cylinder as the plate. The cylinder has the top and bottom portions thereof closed, and a supply pipe is connected to the inside of the cylinder to supply into the inside of the cylinder the molten lead-free solder having the intermetallic compounds deposited therewithin. When the molten lead-free solder flows outwardly through the cylinder, the intermetallic compounds merge with each other into particles having larger diameter.

Preferably, in the granulation bath the first plate is formed as a first cylinder and the second plate is formed as a second cylinder. The second cylinder is arranged outside the first cylinder with the top and bottom portions of the first and second cylinders closed. A supply pipe is connected to the inside of the first cylinder to supply into the inside of the first cylinder the molten lead-free solder having the intermetallic compounds deposited therewithin. The molten solder passes through the first plate and the second plate in that order. The intermetallic compounds having merged through the smaller openings further merge while passing through the larger diameter openings. Gradually, the particle diameter increases. The particle diameters of the intermetallic compounds flowing out through the second plate become even larger. The precipitation and separation process is even more efficiently performed in the separation bath.

Any number of plates in the granulation bath is acceptable. At least one plate is arranged in the passage of the molten lead-free solder. If a plurality of plates is arranged, the intermetallic compounds are merged through the plates in order to increase gradually the diameter of the particles of the intermetallic compounds. In this arrangement, the diameter of the openings in the plate arranged upstream of the passage of the molten lead-free solder is preferably smaller than the diameter of the openings in the plate arranged downstream of the passage of the molten lead-free solder.

Preferably, the separation bath includes whirl current generating means for causing a whirl current in the molten solder in order to precipitate the intermetallic compounds at the bottom center portion of the bath. The whirl current thus guides the enlarged intermetallic compounds to the center portion of the bath. The whirl current generating means may be an agitating means arranged in the separation bath. In such a case, the agitating means and a drive mechanism thereof must be arranged in the separation bath. Preferably the nozzle supplying the molten lead-free solder containing the enlarged intermetallic compounds to the separation bath is arranged at an inclination with respect to a vertically axis. With this arrangement, the nozzle itself works as the whirl current generating means.

In the above arrangement, the metal added into the deposition bath may be any one that can react with tin like as with copper and cause the interemtallic compound to be deposited in the molten solder. The element X is preferably at least one element selected from transition metals such as Ni, Co, and Fe.

Advantages

In accordance with the present invention, the metal added in the deposition bath and excess copper in the molten solder react on tin in the molten solder and then the intermetallic compound, formed of the metal added in the deposition bath, excess copper in the molten solder, and tin in the molten solder, is deposited in the deposition bath. The intermetallic compounds having a small particle diameter become enlarged in the granulation bath. The precipitation speed of the intermetallic compounds is increased in the separation bath. The arrangement eliminates the need for a large-scale facility, and tin is retrieved safely and efficiently.

REFERENCE NUMERALS

Figure 1:
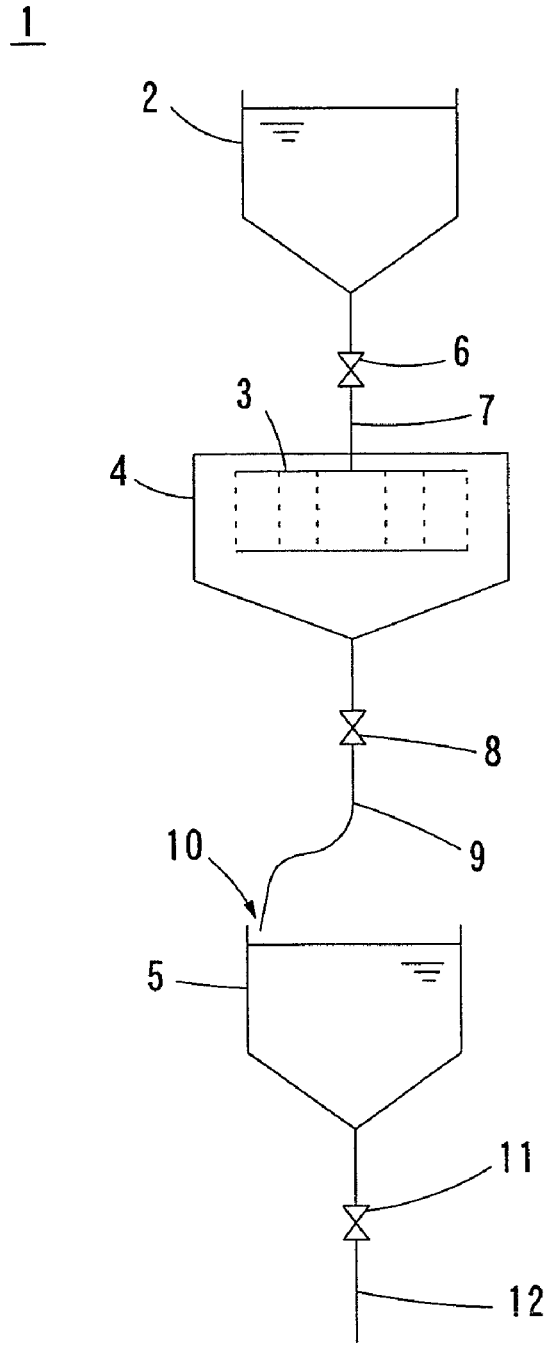
FIG. 1 illustrates the concept of a deposition and separation apparatus for excess copper in lead-free solder.

1 Deposition and separation apparatus
2 Deposition bath
3 Granulation device
4 Granulation bath
5 Separation bath
10 Nozzle
31, 32, 33 Plates
50 Whirl current generating means

BEST MODE FOR CARRYING OUT THE INVENTION

The embodiments of the present invention are described below with reference to the drawings. FIG. 1 illustrates the concept of a deposition and separation apparatus 1 for depositing and separating excess copper in the lead-free solder in accordance with the present invention. The deposition and separation apparatus 1 includes a deposition bath 2 for depositing the excess copper dissolved in molten solder as an intermetallic compound, a granulation bath 4 including granulation device 3, and a separation bath 5 for precipitating and separating the intermetallic compound of the excess copper. The deposition bath 2 is connected to the granulation bath 4 via a supply pipe 7 with a valve 6. The supply pipe 7 supplies the molten solder from the deposition bath 2 to the granulation bath 4. The granulation bath 4 is connected to the separation bath 5 via a supply pipe 9 with a valve 8. The supply pipe 9 supplies the molten solder from the granulation bath 4 to the separation bath 5. The supply pipe 9 supplying the molten solder to the separation bath 5 is provided with a nozzle 10 at the end thereof. The molten solder flows into the separation bath 5 through an orifice of the nozzle 10. The separation bath 5 is also provided with a valve 11 and a pipe 12 for retrieving the lead-free solder (with the main element thereof being tin) with the excess copper removed therefrom.

Figure 2:
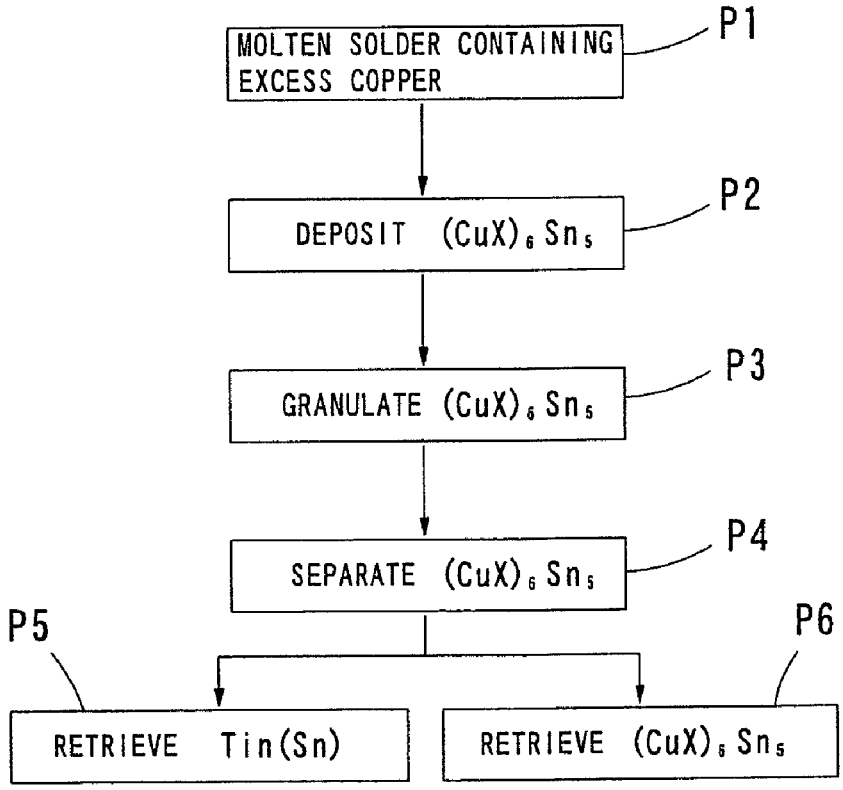
FIG. 2 is a flow chart of a tin recycling process performed by the deposition and separation apparatus for excess copper in lead-free solder.

FIG. 2 is a flowchart illustrating a tin recycling process of the deposition and separation apparatus 1. The deposition and separation apparatus 1 supplies to the deposition bath 2 the molten solder containing excess copper that is dissolved therein due to copper leaching of a printed board or the like (process P1). The deposition bath 2 may be used as a solder bath to perform a soldering process. A metal is added to the deposition bath 2, and the excess copper is deposited as a predetermined intermetallic compound (process 2). More specifically, if an element X is added, the element X is deposited together with copper and tin as a $(CuX)_6Sn_5$ system compound. The molten solder containing the intermetallic compound is supplied to the granulation bath 4, and then granulated there (process P3). Since particles of intermetallic compound have a small diameter, the granulation device 3 granulates the intermetallic compound into a large diameter particle. The molten solder containing the enlarged intermetallic compound is then supplied to the separation bath 5 where the intermetallic compound is separated (process P4). From the separation bath 5, tin (Sn) is retrieved, and the separated intermetallic compound is retrieved (processes P5 and P6). The retrieved tin is recycled as a further solder material. The intermetallic compound of the excess copper may be dumped or refined into copper, tin, and other materials for recycling.

Figure 3:
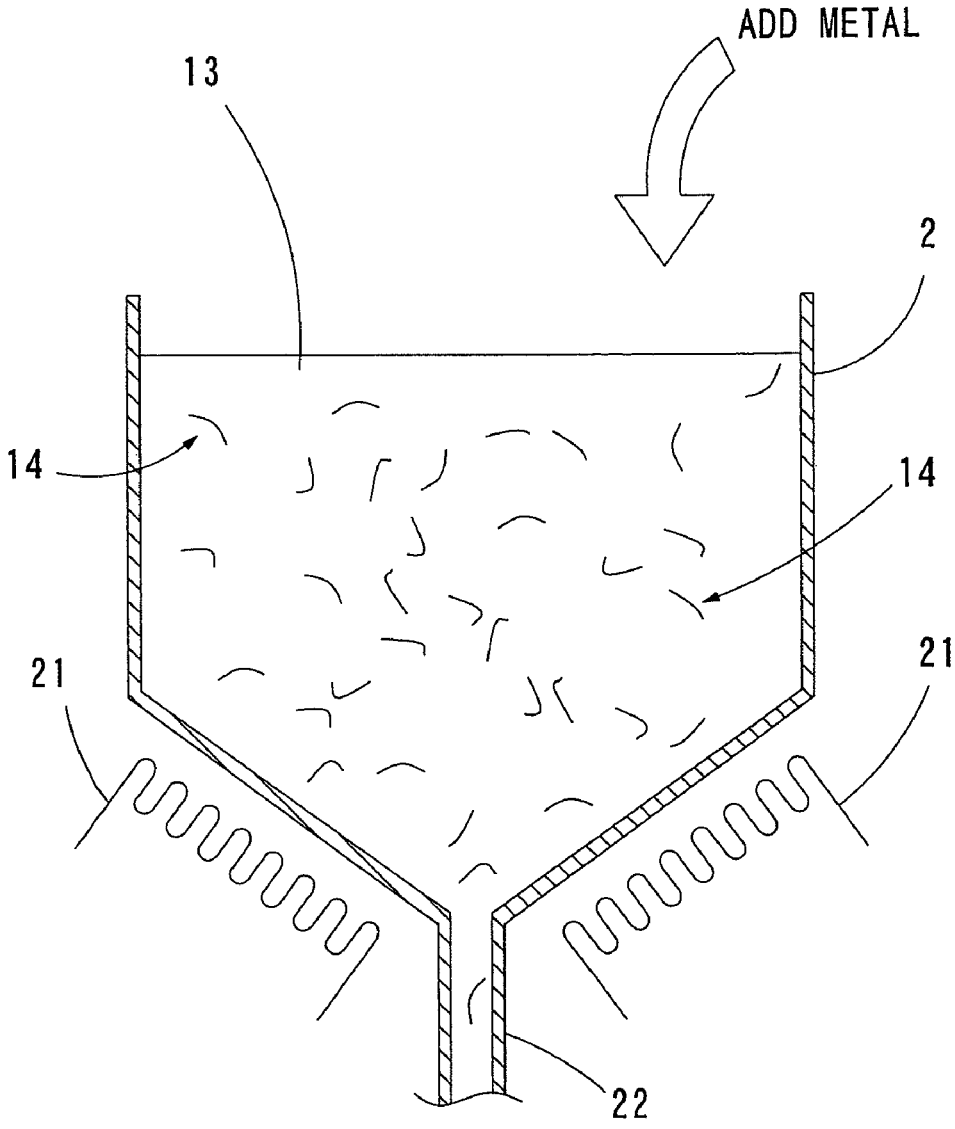
FIG. 3 illustrates a deposition bath.

FIG. 3 illustrates the concept of the deposition bath 2. Lead-free solder 13 containing excess copper dissolved therein is supplied to the deposition bath 2. A heater 21 heats the lead-free solder 13 to a temperature within a predetermined range to keep the lead-free solder 13 at a melting state. In this state, an appropriate amount of a predetermined element X as a metal is added to the deposition bath 2 by adding a mother alloy which includes the predetermined element X diluted in high-concentration with pure tin. By adding the metal element X, a $(CuX)_6Sn_5$ system compound 14 is deposited in the deposition bath 2. The heating temperature by the heater 21 may be set to be equal to or above a solder melting temperature and equal to or below a temperature at which the deposited $(CuX)_6Sn_5$ system compound melts. More specifically, the heating temperature may be within a range from 230 to 250° C.

The element X may be the one that does not form an intermetallic compound with copper (Cu), but forms a intermetallic compound with tin (Sn), and may be Ni, Co, Fe, Pt, or the like. More preferably, the element X is a transition metal such as Ni, Co, or Fe. With a proper amount of these elements added, the $(CuX)_6Sn_5$ system compound as the intermetallic compound having a crystal structure having a melting point higher than the solder is formed in the molten solder. The added element X is not necessary one type. Two types or more types of elements X selected from Ni, Co, Fe, etc. may be added. After the intermetallic compound is deposited, the lead-free solder 13 is guided to the granulation bath 4 via the supply pipe 7 connected to a drain hole 22 arranged on the bottom of the deposition bath 2.

Figure 4:
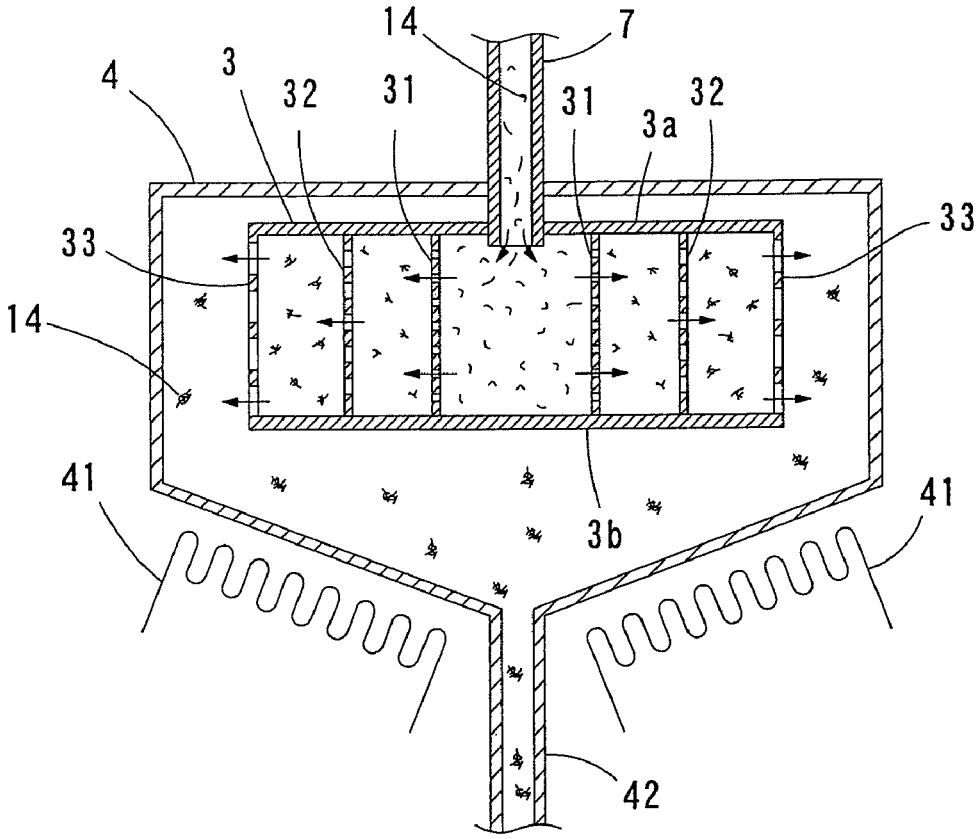
FIG. 4 illustrates the concept of a granulation bath.
Figure 5:
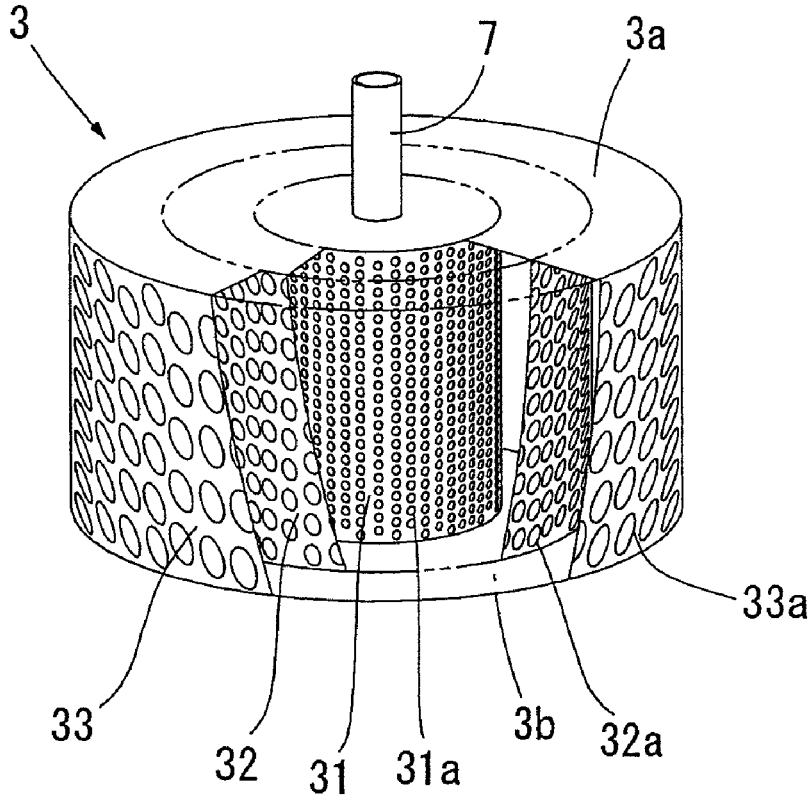
FIG. 5 illustrates the structure of granulation means arranged in the granulation bath with part thereof removed.

FIG. 4 illustrates the concept of the granulation bath 4. FIG. 5 illustrates the granulation device 3 installed in the granulation bath 4 with a portion thereof removed. As shown in FIG. 4, the granulation bath 4 includes the granulation device 3 therein and a heater 41 to heat the granulation bath 4. The heater 41 heats the inner temperature of the granulation bath 4 to within a temperature range of 230 to 250° C. to keep the lead-free solder in the melting state thereof. By causing the molten solder to pass through the granulation device 3 in the granulation bath 4, the fine particle intermetallic compounds contained in the molten solder are granulated into larger particles, and the resulting intermetallic compounds in the large particles are easy to be separated from the molten solder. The granulation device 3 includes plurality of plates 31, 32, and 33, and each of the plates 31, 32, and 33 has a large number of openings penetrating therethrough. The plates 31, 32, and 33 are arranged in that order from upstream of the passage of the molten solder downward, and the openings of the plates preferably increase in diameter from upstream to downstream. The diameter of the openings formed in the plate 31 is smallest of the openings in the plates 32 and 33. The diameter of the openings formed in the plate 32 is larger than the diameter of the openings formed in the plate 31 but smaller than the diameter of the openings formed in the plate 33. The diameter of the openings formed in the plate 33 is the largest of the diameters of the openings formed in the plates 31 and 32. The molten solder supplied via the supply pipe 7 is introduced into the granulation device 3 and successively passes through the plates 31, 32, and 33 and then flows out from the granulation device 3.

The plates 31, 32, and 33 are not limited to any particular shape, and may be a combination of flat plates successively arranged, or may be a combination of cylinders. In accordance with the present embodiment, the plates 31, 32, and 33 are cylinders coaxially arranged as shown in FIG. 5. The plates 31, 32, and 33 are arranged from inner to outer in that order. The top portion and the bottom portion of each of the cylinder plates 31, 32, and 33 are closed with a top plate 3*a* and a bottom plate 3*b*, respectively. The supply pipe 7 communicates with the inside of the plate 31, and the molten solder containing the intermetallic compound flows into the inside of the plate 31. The molten solder in the plate 31 then passes through the openings 31*a* of the plate 31, and runs into between the plate 31 and the plate 32. The molten solder then passes through the openings 32*a* of the plate 32, thereby running into between the plate 32 and the plate 33. Furthermore, the molten solder passes through the openings 33*a* of the plate 33, thereby running out of the granulation device 3.

A large number of openings 31*a*, 32*a*, and 33*a* of the plates 31, 32, and 33 stepwise increase the diameters thereof as it goes from inner to outer in the granulation device 3. The diameter of the openings 31*a* of the first plate 31 arranged at the innermost location in the granulation device 3 (at a location upstream of the passage of the molten solder) is smaller than the diameter of the openings 32*a* of the second plate 32, and the diameter of the openings 32*a* of the second plate 32 is smaller than the diameter of the openings 33*a* of the third plate 33. More specifically, the diameter of the openings 31*a* of the first plate 31 may be 2 mm, the diameter of the openings 32*a* of the second plate 32 may be 3 mm, and the diameter of the openings 33*a* of the third plate 33 may be 4 mm, for example. The plate may be made of metallic mesh. As shown in FIG. 5, the use of a punching metal that is formed by punching a plurality of openings in a metal sheet is preferable in terms of mechanical strength and inner diameter dimensional accuracy.

By causing the intermetallic compound, namely, $(CuX)_6Sn_5$ system compound together with the molten solder to pass through the plurality of plates 31, 32, and 33 consecutively, the $(CuX)_6Sn_5$ system compounds 14 merge with each other each time the $(CuX)_6Sn_5$ system compounds 14 pass the openings 31*a*, 32*a*, and 33*a* of the plates 31, 32, and 33, and the particle diameters of the $(CuX)_6Sn_5$ system compounds 14 gradually increase. The molten solder, containing the intermetallic compounds granulated by the granulation bath 4 and then enlarged, is then supplied to the separation bath 5 via the supply pipe 9 connected to the drain hole 42 arranged in the bottom of the granulation bath 4.

In accordance with the present embodiment, the granulation device 3 includes three plates, but any number of plates may be used. Even with one plate, the particle diameter is increased when the intermetallic compounds pass through the openings in the plate. The number of plates may be two. Alternatively, four or more plates may be employed.

Figure 6:
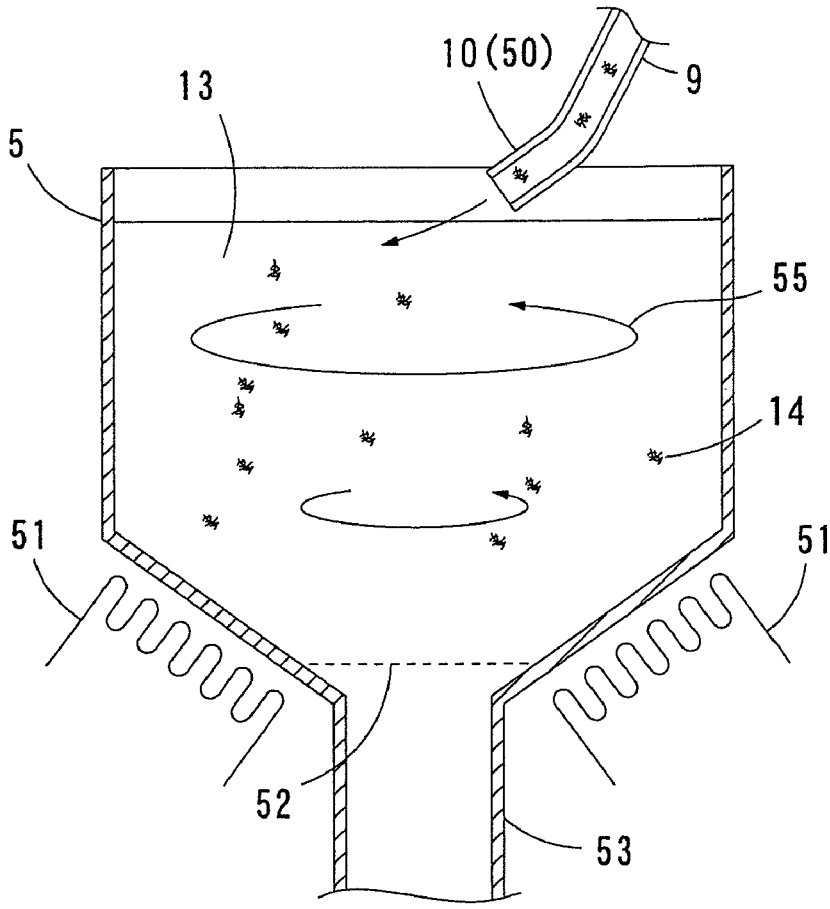
FIG. 6 illustrates the concept of a separation bath.

FIG. 6 illustrates the concept of the separation bath 5. The separation bath 5 causes the intermetallic compounds enlarged in the molten solder 13 to precipitate and separate therewithin. The separation bath 5 includes heaters 51 to heat the bath temperature thereof to within a range from 230 through 250° C. to maintain the molten state of the solder. The separation bath 5 includes a drain hole 53. The drain hole 53 is formed in the center of a bottom of the separation bath 5 to retrieve tin (molten solder) and connected to the pipe 12. A receptacle plate 52 made of metal mesh and so on is arranged above the drain hole 53 to receive the precipitated intermetallic compounds. During precipitation, the intermetallic compound preferably falls toward the receptacle plate 52 in the bottom center of the separation bath 5. The separation bath 5 creates an whirl current 55 in the molten solder 13 therewithin so that the whirl current 55 places the intermetallic compound in the bath center. In accordance with the present embodiment, the nozzle 10 is arranged, as whirl current generation means 50, at an inclination with respect to a vertically axis at the end of the supply pipe 9 supplying the molten lead-free solder containing the enlarged intermetallic compounds 14 to the separation bath 5 as shown in FIG. 6. By supplying the molten solder along the inner wall of the separation bath 5 from the nozzle 10, the whirl current 55 is caused in the molten solder 13 within the bath. The present invention is not limited to this mechanism. Alternatively, the whirl current 55 may be created by arranging agitation means within the separation bath 5.

Figure 7:
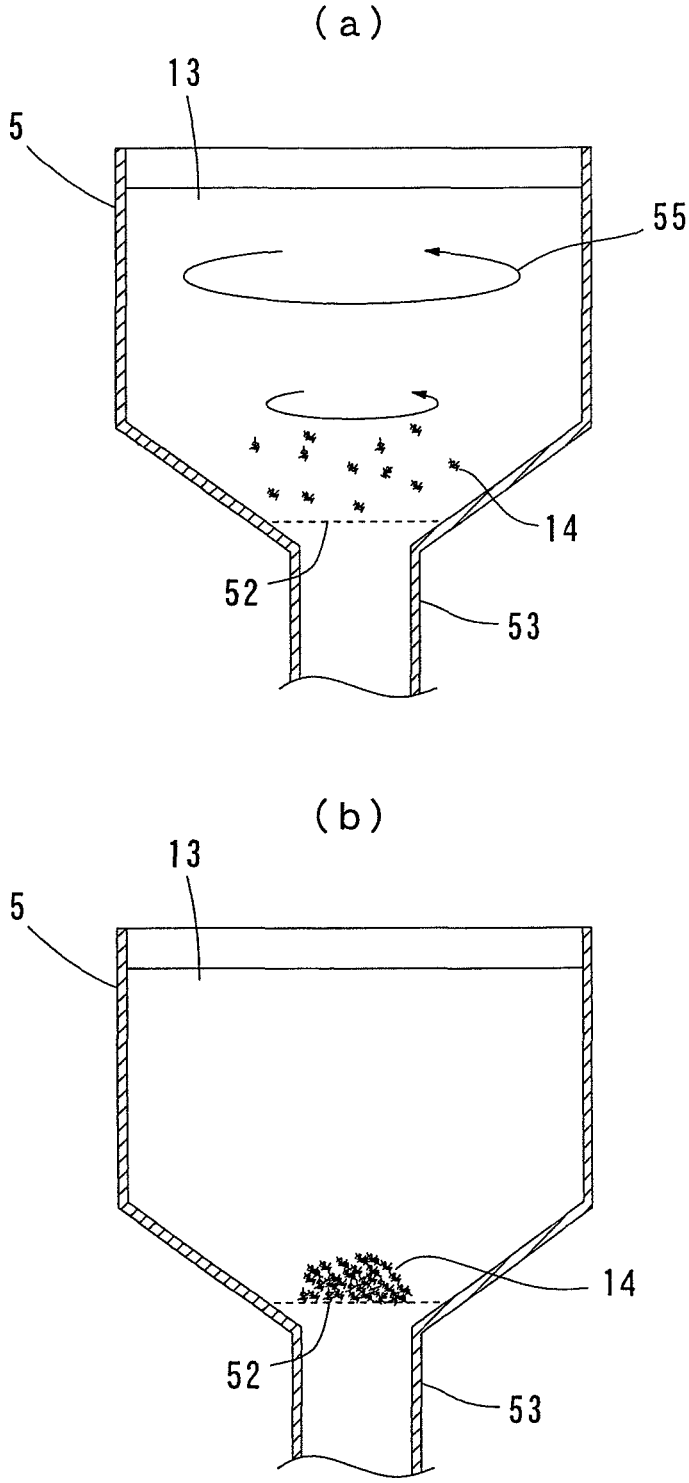
FIG. 7 illustrates a precipitation and separation process in the separation bath, FIG. 7(*a*) illustrates a agitation process by an whirl current during agitation, and FIG. 7(*b*) illustrates a state subsequent to the stop of the whirl current.

FIG. 7 illustrates a precipitation and separation process taking place in the separation bath 5. FIG. 7(*a*) illustrates the molten solder agitated by the whirl current and FIG. 7(*b*) illustrates the molten solder after the whirl current is stopped. When the whirl current 55 is generated in the separation bath 5 shown in FIG. 7(*a*), the intermetallic compound 14, namely the $(CuX)_6Sn_5$ system compounds, are attracted by the whirl current 55 and gradually aggregate on the bottom center of the separation bath 5. When the whirl current is stopped by stopping the supply of the molten solder to the separation bath 5, the intermetallic compounds 14 precipitate on the receptacle plate 52 of the bottom center in the separation bath 5 as shown in FIG. 7(*b*). If the valve 11 (see FIG. 1) of the pipe 12 connected to the drain hole 53 of the separation bath 5 is opened in this state, the molten solder 13 containing high-purity tin can be retrieved. A drain hole to retrieve the remaining high-purity tin as the molten solder 13 may be arranged in the upper portion of the wall of the separation bath 5, and only the upper layer of molten tin may be drained for retrieval.

As shown, the receptacle plate 52 is arranged above the drain hole 53, and the intermetallic compounds are retrieved using the receptacle plate 52. The present invention is not limited to this arrangement. The intermetallic compound may be trained through the drain hole 53 so that molten solder containing high-purity tin may be left in the separation bath 5. With the intermetallic compounds precipitating on the center bottom portion of the separation bath 5, the intermetallic compounds may be sucked with suction means arranged in the separation bath 5.

As described above, the deposition and separation apparatus 1 for excess copper in the lead-free solder successively processes the molten solder containing excess copper dissolved therewithin using the deposition bath 2, the granulation bath 4, and the separation bath 5. The excess copper is thus separated, and the high-purity tin is efficiently retrieved. In particular, the granulation bath 4 granulates the fine particle intermetallic compounds made of excess copper into large particle intermetallic compound using the granulation device 3. The precipitation speed of the intermetallic compound in the separation bath 5 becomes faster. The excess copper is thus efficiently separated. An increase in energy costs required to separate the intermetallic compound is thus controlled. The apparatus is smaller in facility size than the facility used in the known tin retrieval method. The method of the present invention, free from a dangerous facility, assures safety operation.

Used solder may be retrieved from a dip soldering bath or a wave soldering bath, and tin is retrieved using the deposition and separation apparatus 1 in a recycling plant. Without transferring the retrieved solder to a different location, the deposition and separation apparatus 1 may be installed alongside the dip soldering bath or the wave soldering bath so that tin is retrieved in parallel with a soldering operation. Since dissolved excess copper may be separated as a part of the entire operation in the latter case, adjustment of the copper concentration in the solder bath is usefully performed.

INDUSTRIAL APPLICABILITY

In accordance with the present invention, the excess copper dissolved in the lead-free solder bath is separated and tin is efficiently retrieved from the molten solder. The retrieved tin is recycled as a solder resource material.

The invention claimed is:

1. A deposition and separation apparatus for depositing and separating, as an intermetallic compound, excess copper dissolved in molten lead-free solder having tin as the main element thereof, comprising:

a deposition bath for causing an intermetallic compound of tin in the molten lead-free solder, a metal added from the outside and copper in the molten lead-free solder to be deposited with the lead-free solder maintained at a molten state thereof, a granulation bath including a first plate having a large number of openings, each opening having a smaller diameter, and a second plate having a large number of openings, each opening having a larger diameter, and wherein the granulation bath causes the molten lead-free solder to pass through the second plate after causing the molten lead-free solder to pass through the first plate to merge the intermetallic compounds with each other into particles having a larger diameter, and a separation bath for causing the enlarged intermetallic compounds to precipitate and separate in the molten lead-free solder.

2. A deposition and separation apparatus for depositing and separating, as an intermetallic compound, excess copper dissolved in molten lead-free solder having tin as the main element thereof, comprising:

a deposition bath for causing an intermetallic compound of tin in the molten lead-free solder, a metal added from the outside and copper in the molten lead-free solder to be deposited with the lead-free solder maintained at a molten state thereof, a granulation bath including a plate having a large number of openings for allowing the molten lead-free solder to pass through the plate to merge the intermetallic compounds with each other into particles having a larger diameter, wherein the granulation bath comprises a cylinder as the plate, and wherein the cylinder has the top and bottom portions thereof closed, and a supply pipe is connected to the inside of the cylinder to supply into the inside of the cylinder the molten lead-free solder having the intermetallic compounds deposited therewithin and a separation bath for causing the enlarged intermetallic compounds to precipitate and separate in the molten lead-free solder.

3. The deposition and separation apparatus according to claim 1, wherein the first plate is formed as a first cylinder and the second plate is formed as a second cylinder, wherein the second cylinder is arranged outside the first cylinder with the top and bottom portions of the first and second cylinders closed, and where a supply pipe is connected to the inside of the first cylinder to supply into the inside of the first cylinder the molten lead-free solder having the intermetallic compounds deposited therewithin.

4. A deposition and separation apparatus for depositing and separating, as an intermetallic compound, excess copper dissolved in molten lead-free solder having tin as the main element thereof, comprising:

a deposition bath for causing an intermetallic compound of tin in the molten lead-free solder, a metal added from the outside and copper in the molten lead-free solder to be deposited with the lead-free solder maintained at a molten state thereof, a granulation bath including a plate having a large number of openings for allowing the molten lead-free solder to pass through the plate to merge the intermetallic compounds with each other into particles having a larger diameter, and a separation bath for causing the enlarged intermetallic compounds to precipitate and separate in the molten lead-free solder, wherein the separation bath comprises whirl current generating means for causing a whirl current therewithin, and wherein the enlarged intermetallic compounds are guided to the center portion of the whirl current.

5. The deposition and separation apparatus according to claim 4, wherein the whirl current generating means comprises a nozzle arranged at an inclination with respect to a vertical axis, the nozzle supplying the molten lead-free solder containing the enlarged intermetallic compounds to the separation bath.

* * * * *